United States Patent [19]

Jarvis

[11] 4,054,321

[45] Oct. 18, 1977

[54] TRACK-MOUNTED SHOE-SUPPORTED INCLINING MINING MACHINE

[75] Inventor: William Joseph Jarvis, Bestwood, England

[73] Assignee: Coal Industry (Patents) Ltd, London, England

[21] Appl. No.: 709,244

[22] Filed: July 27, 1976

[30] Foreign Application Priority Data

Aug. 13, 1975 United Kingdom ..... 33644/75

[51] Int. Cl.[2] ..... E21C 27/36; E21C 27/24

[52] U.S. Cl. ..... 299/43; 299/34

[58] Field of Search ..... 299/31–34, 299/43; 61/45 D

[56] References Cited

FOREIGN PATENT DOCUMENTS

| | | | |
|---|---|---|---|
| 53,970 | 9/1967 | Poland | 299/43 |
| 1,092,294 | 11/1967 | United Kingdom | 299/43 |

*Primary Examiner*—Ernest R. Purser

*Attorney, Agent, or Firm*—James C. Wray

[57] ABSTRACT

The shoes on the goaf side of a longwall mineral mining machine comprise pivotally connected components so that the machine can hinge about these shoes during steering adjustments. Longitudinal pins connect components of goaf side shoes so that a pinion driven by the machine is maintained in engagement with a rack fixed to the track.

9 Claims, 2 Drawing Figures

TRACK-MOUNTED SHOE-SUPPORTED INCLINING MINING MACHINE

Figure 1:
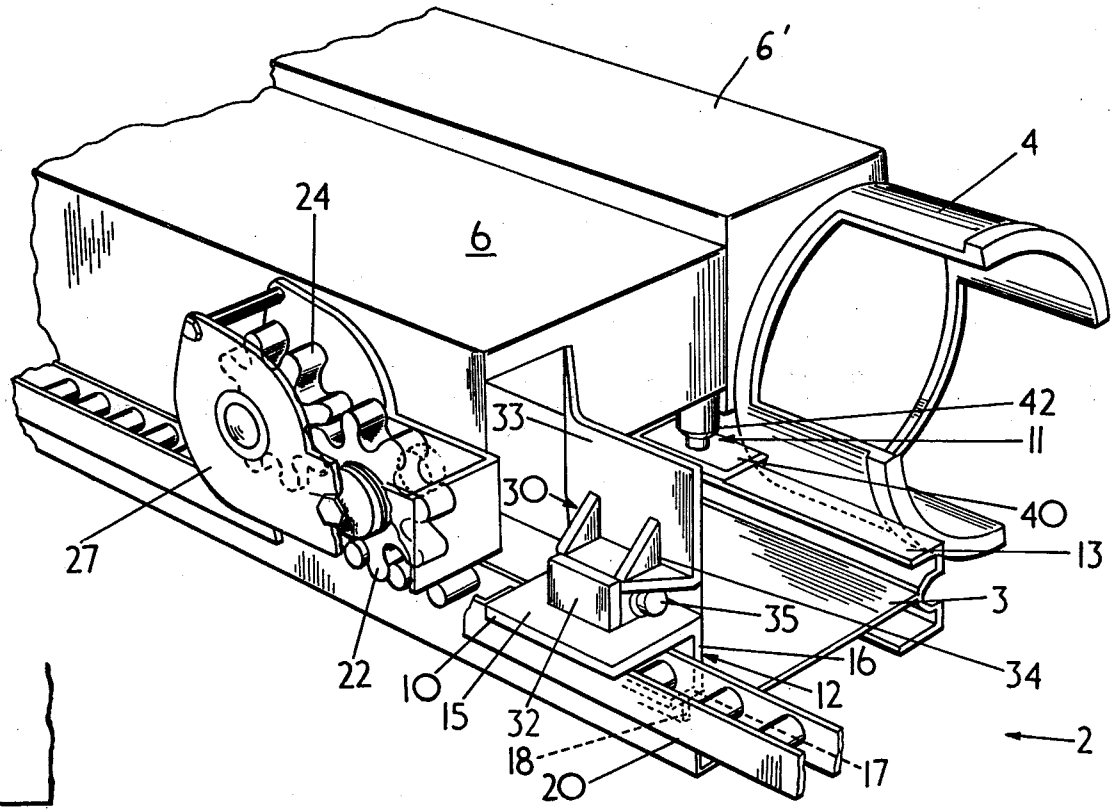

This invention relates to mining machines.

In particular the invention relates to a mining machine which traverses to and fro along a longwall face coneyor, at least a part of the machine's weight being carried by the conveyor and which has steering mechanisms for adjusting the inclination of the machine body with respect to the conveyor to vary the cutting horizon of a cutter provided on the machine.

It is known for a mining machine to be provided with shoes which slide along the upper flanges of the conveyor and the sliding faces of which lie in planes fixed with respect to the machine body. The shoes along at least one side of the machine body may be telescopically adjustable to steer the machine. Such an arrangement suffers from the disadvantage that when the inclination of machine body is adjusted with respect to the conveyor the sliding faces of the shoes are tilted and caused to make line contact with the conveyor flanges. Consequently, the sliding faces rapidly wear and the shoes frequently need to be replaced.

It has also been proposed to support the machine body on an underframe assembly comprising a lower bridge part which straddles the conveyor to engage on both upper conveyor flanges and an upper machine supporting part pivotally mounted on the lower bridge part for movement about an axis generally parallel to the conveyor, pivotal movement being controlled by rams. Unfortunately, such a proposed underframe has never been widely adopted as the machine height has to be increased usually beyond acceptable limits in order to accommodate the underframe.

An object of the present invention is to provide a mining machine which tends to overcome the above mentioned problems.

According to the present invention a mining machine which in use traverses to and fro along a track including an armoured face conveyor extending along a longwall mineral face, at least a part of the machine being supported by the track, comprises a body, and a number of track engaging shoes for supporting at least a part of the body and adapted to engage the track for movement along the track, at least one of the track engaging shoes comprising a first component for engaging the track and a second component connected to the body and pivotally mounted on the first component, at least one further of the track engaging shoes being connected to the body at a location remote from the previously mentioned at least one track engaging shoe and including a ram which in use is adjustable to vary the inclination of the machine body with respect to the track, the said second component pivoting relative to the said first component.

Preferably, the or each first mentioned at least one track engaging shoe is provided on one side of the body and the or each further track engaging shoe is mounted on the opposite side of the body.

The body may overhang the track in a direction towards the mineral face and in which case mine floor engaging shoes may be provided for stabilising the overhanging portion of the body.

Preferably, at least one of the track engaging shoes is trapped or captivated to the track to retain the machine on the track.

Conveniently, the first mentioned at least one track engaging shoe may be provided adjacent one end of the machine body and the or each further track engaging shoe may be provided on the opposite end of the machine body.

Figure 2:
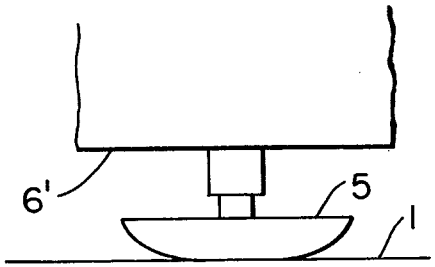

By way of example only, one embodiment of the present invention will be described with reference to the accompanying drawing FIG. 1 shows a perspective view of a part of a mining machine constructed in accordance with the present invention. FIG. 2 is a schematic detail of a stabilizing shoe.

The mining machine shown in the drawing is a conveyor mounted trepanner which in use traverses to and fro along a track 2 including armoured face conveyor 3 extending along a longwall mineral face (not shown) and which has a rotary cutter device (a part of which is shown at 4) at each end for winning mineral in both directions of travel along the face; only one end of the machine is shown in the drawing.

The machine has a body 6 partly supported by the track and partly overhanging the face side of the conveyor towards the newly exposed mineral face. Telescopic stabilising shoes 5 having rams are provided on the overhung part 6 of the machine body which engage the mine floor 1 formed by the cutter device to support and stabilise the overhung part of the body. The remainder of the body is supported on track engaging shoes 10 and 11 (only one of each of which is shown) mounted on opposite sides of the track, respectively.

Each of the track engaging shoes 10 comprises a first component 12 which slidably engages an upper horizontal flange (not shown) of the conveyor 3. Although this upper horizontal flange is omitted from the drawing for the sake of clarity, it is identical to the upper horizontal flange 13 on the opposite side of the conveyor which is discussed later in this specification.

The first component 12 comprises a horizontal plate 15 having a vertical plate 16 extending downwardly to a shorter horizontal plate 17 the face side of which slidably engages the upper flange of the conveyor. A lower shot vertical plate 18 extends down the goaf side of the conveyor guiding the machine along the track. The upper and lower horizontal plates 15 and 17 engage above and below a haulage rack 20 constituting a part of the track to trap or captivate the machine to the track. The rack 20 is drivably engaged by a pinion 22 driven by a motor within the machine body 6 via a further pinion 24 to haul the machine to and fro along the track. The pinions 22, 24 are rotatably mounted in a framework 27 fixedly secured to the machine body.

The track engaging shoe 10 also comprises a second component 30 connected to the machine body 6 and supported in a pivotal mounting bracket 32 provided on the upper horizontal plate 15 of the first component. The second component includes a curved vertical plate 33 which serves to guide cut mineral flowing on the conveyor under the machine body and a bracket 34 which co-operates with the pivotal mounting bracket 32 and pin 35 to form a hinge support for the machine body.

Each of the track engaging shoes 11 is telescopic and comprises a horizontal slide pad 40 for sliding along the upper horizontal flange 13 of the conveyor and a vertical ram 42 secured between the slide pad 40 and the machine body 6. Actuation of the rams 42 adjusts the inclination of the machine body relative to the conveyor, pivoting the second component 30 of each of the shoes 10 about its pivotal mounting on the associated first component 12, to vary the cutting horizon of the cutter devices to steer the machine within the mineral seam.

Typically the machine body is supported on four track engaging shoes, i.e. two shoes 10 and two shoes 11, and two stabilising shoes 5 provided on the overhung portion of the body. As stated previously, the machine is steered by actuation of the two vertical rams 42 mounted on one side of the track supported portion of the machine body, the machine body pivoting about pivotal mountings on the shoes 10 mounted on the goaf side of the machine body. The stabilising shoes serve to stabilise the overhung portion of the machine body irrespective of the machine's inclination.

In other modifications of the invention the position of the shoes may be reversed so that the pivotal mountings are located on the mineral face side of the track and the telescopic shoes are provided on the goaf side of the track.

In further embodiments the machine is completely supported by the track.

In still further modifications of the invention, the telescopic shoes are mounted adjacent to one end of the machine and the pivotal mountings are provided adjacent to the opposite end of the machine.

I claim:

1. A mining machine which in use traverses to and fro along a track including an armoured face conveyor extending along a longwall mineral face, at least a part of the machine being supported by the track, comprising a body, and a number of track engaging shoes for supporting at least a part of the body and adapted to engage the track for movement along the track, at least one of the track engaging shoes comprising a first component for engaging the track and a second component connected to the body and pivotally mounted on a horizontal pin connected to the first component, at least one further of the track engaging shoes being connected to the body at a location remote from the previously mentioned at least one track engaging shoe and including a ram which in use is adjustable to vary the inclination of the machine body with respect to the track, the said second component pivoting relative to the said first component.

2. A machine according to claim 1, in which the or each first mentioned at least one track engaging shoe is provided on one side of the body and the or each further track engaging shoe is mounted on the opposite side of the body.

3. A machine as claimed in claim 1, in which the body overhangs the track in a direction towards the mineral face.

4. A machine according to claim 3, in which floor engaging shoes are provided for stabilising the overhanging portion of the body.

5. A machine as claimed in claim 1, in which at least one of the track engaging shoes is trapped or captivated to the track to retain the machine on the track.

6. A machine as claimed in claim 1, in which the first mentioned at least one track engaging shoe is provided adjacent one end of the machine body and the or each further track engaging shoe is provided on the opposite end of the machine body.

7. A mining machine which in use traverses to and fro along a track defining a succession of abutments extending along a longwall mineral face in a mineral seam, at least a part of the machine being supported by the track, comprising a body, motor means within the body, a pinion driven by the motor means for sequential drivable engagement with the abutments, cutter means driven by the motor means for winning mineral as the machine traverses along the face, and a number of track engaging shoes for supporting at least a part of the body and adapted to engage the track for movement along the track, at least one of the track engaging shoes comprising a first component for engaging the track adjacent to the abutments to captivate the machine to the track and a second component fixedly connected to the body and pivotally mounted on the first component, at least one further of the track engaging shoes being connected to the body at a location remote from the previously mentioned at least one track engaging shoe and including a ram which in use is actuatable to vary the inclination of the machine body with respect to the track to adjust the cutting horizon of the cutter means to steer the machine within the mineral seam, the said second component pivoting relative to the said first component when the inclination of the machine is varied enabling said at least one of the track engaging shoes to ensure that the pinion is maintained in driveable engagement with the abutments throughout the variation in the machine's inclination.

8. A machine according to claim 7, in which the or each first mentioned at least one track engaging shoe is provided on one side of the body and the or each further track engaging shoe is mounted on the opposite side of the body.

9. A machine as claimed in claim 7, in which the body overhangs the track in a direction towards the mineral face.

* * * * *